US006417826B1

(12) United States Patent
Bonnett et al.

(10) Patent No.: US 6,417,826 B1
(45) Date of Patent: Jul. 9, 2002

(54) LIQUID CRYSTAL DEVICE AND METHOD OF ADDRESSING LIQUID CRYSTAL DEVICE

(75) Inventors: Paul Bonnett, Littlemore; Michael John Towler, Botley; Diana Cynthia Ulrich, Oxford, all of (GB)

(73) Assignees: Sharp Kabushiki Kaisha, Osaka (JP); The Secretary of State for Defence in Her Brittanic Majesty's Government of the United Kingdom of Great Britain and Northern Ireland, Farnborough (GB)

( * ) Notice: Subject to any disclaimer, the term of this patent is extended or adjusted under 35 U.S.C. 154(b) by 0 days.

(21) Appl. No.: 09/245,274

(22) Filed: Feb. 5, 1999

(30) Foreign Application Priority Data

Feb. 9, 1998 (GB) ..... 9802810

(51) Int. Cl.[7] ..... G09G 3/36

(52) U.S. Cl. ..... 345/87; 345/97; 345/96; 345/94; 345/99; 349/1

(58) Field of Search ..... 345/87, 89, 102, 345/98, 97, 94, 96, 99; 349/1

(56) References Cited

U.S. PATENT DOCUMENTS

| | | | | |
|---|---|---|---|---|
| 5,515,073 A | * | 5/1996 | Surguy | 345/97 |
| 5,844,537 A | * | 12/1998 | Bonnett et al. | 345/97 |
| 6,054,973 A | * | 4/2000 | Hughes et al. | 345/97 |

FOREIGN PATENT DOCUMENTS

| | | |
|---|---|---|
| EP | 0880125 | 11/1998 |
| GB | 2 323 960 | 10/1998 |
| GB | 2325555 | 11/1998 |
| GB | 2325556 | 11/1998 |
| JP | 05027719 | 2/1993 |
| JP | 05027720 | 2/1993 |
| WO | 9527971 | 10/1995 |

OTHER PUBLICATIONS

P.W.H. Surguy et al., Ferroelectrics, 1991, vol. 122, pp. 63–79, "The "Joers/Alvey" Ferroelectric Multiplexing Scheme".

T. Yamaguchi et al., Journal of the SID, 4/4, 1996, pp. 263–270, "Degradation of Moving–Image Quality in PDPS: Dynamic False Contours".

Pending U.S. Pending Application Serial No. 09/080,601, Filed May 18, 1998.

Pending U.S. Pending Application Serial No. 09/080,164, Filed on May 15, 1998.

Great Britain Examination Report under Section 18(3); Application No. GB 9802810.3 dated Nov. 15, 2001.

* cited by examiner

*Primary Examiner*—Richard Hjerpe
*Assistant Examiner*—Ali Zamani
(74) *Attorney, Agent, or Firm*—Renner, Otto, Boisselle & Sklar

(57) ABSTRACT

A method of addressing a liquid crystal device having a plurality of scanning electrodes and a plurality of data electrodes defining a plurality of pixels at the intersections between at least one of the plurality of scanning electrodes and at least one of the plurality of data electrodes, the method comprising applying one frame of a scanning signal to one of the plurality of scanning electrodes, applying a data signal to at least one of the plurality of data electrodes, one frame of the scanning signal comprising n strobe portions, where n is an integer greater than 1, for co-operation with the at least one data signal to address one of the plurality of pixels, and at least one blanking portion, the number of blanking portions not exceeding (n−1).

36 Claims, 11 Drawing Sheets

| STB | 1 | 2 | 3 |
|---|---|---|---|
| + | NSW | NSW | SW |
| − | SW | NSW | NSW |

LIQUID CRYSTAL DEVICE AND METHOD OF ADDRESSING LIQUID CRYSTAL DEVICE

FIELD OF THE INVENTION

The present invention relates to a liquid crystal device, particularly a bistable liquid crystal device, having addressing means for providing a plurality of intermediate levels of light transmission. The invention also comprises a method of addressing a liquid crystal device and an arrangement for addressing a liquid crystal device.

BACKGROUND OF THE INVENTION

In the field, particularly, of ferroelectric liquid crystal devices it is known to utilize a technique known as temporal dither in order to provide one or more intermediate states of light transmission between maximum transmission (generally referred to as white) and minimum transmission (generally referred to as black). By switching a pixel of the display to white for only a fraction of the frame, a grey level is obtained. The switching rate is sufficiently fast that the portions of time spent in the white state and the black state are perceived by the human eye to constitute a level of grey.

In a liquid crystal device array there are typically a first set of electrodes (or row electrodes) arranged on a first substrate of the device and a second set of electrodes (or column electrodes) arranged on an opposite substrate of the device. These sets of electrodes generally comprise electrodes arranged parallel to one another but at right angles to the electrodes in the other set. The intersection between a row electrode and a column electrode defines a picture element or pixel of the array. Each pixel of the array can be uniquely addressed by applying a scanning signal to each of the row electrodes in turn, while a data signal is applied to each of the column electrodes. The data and scanning signals must be carefully selected so that only those pixels in the row to which the scanning signal is applied will adopt the state as a consequence of the data signal. Once a scanning signal has been applied to all of the row electrodes the process can start again with potentially different data signals applied.

The scanning signal typically comprises a blanking pulse and a strobe pulse. The blanking pulse operates independently of the data signal to place all of the pixels in a particular row in a known state (typically the black state). Once the blanking pulse has altered the state of any pixels in the row which have previously occupied the other state, a strobe pulse is applied to the row electrode simultaneously with a data signal. The data signal may be selected from two or more possible data signals to place the pixel in the desired state.

In order to generate a grey level, then at least two strobe signals have to be applied to each row (for temporal dither). These signals are spaced within the frame time of the array device in order to permit different levels of grey to be obtained. FIG. 2(*b*) of the accompanying drawings shows the scanning signal applied to a row electrode in a prior art temporal dither arrangement. The frame is broken down into three durations of relative lengths 1:4:16. Before each of the divided time segments a blanking pulse Ba, Bb, Bc is applied to the row electrode to place all of the pixels in that row in a known state. Then a strobe pulse Sa, Sb, Sc is applied to the row electrode and, in combination with a data signal (not shown), can be used to place the pixel in either of the possible states. By applying the appropriate data signals to co-operate with the strobe pulses S any permutation of the grey levels in the ratios 1:4:16 may be provided.

This prior art arrangement is used in conjunction with a 1:2 spatial dither arrangement (i.e. the pixel is physically subdivided into one third and two thirds of its total area respectively) and this combination provides a total of 64 possible levels (including white and black). This will be discussed in more detail later.

A problem with this prior art arrangement is that it suffers from a lack of contrast and brightness. The reason for this is that the blanking pulses last for some time and, assuming that the display is blanked to black, result in a finite portion of the frame time during which the pixel is black rather than occupying the desired state. Consider the situation where a white (maximum light transmission) state is required. Each of the strobe pulses S will be coincident with a data signal which places the pixel in a white state, Therefore, the pixel will occupy the white state throughout as much of the frame time as is possible. However, for a short period of time prior to each strobe pulse S, the pixel will be in the dark state because of the presence of blanking pulses B. In addition, even when blanking black, transmission response causes a decrease in contrast due to small transmission during the application of the blanking pulse B.

SUMMARY OF THE INVENTION

It is an object of the present invention to provide a liquid crystal device, a method of addressing a liquid crystal device and an arrangement for addressing a liquid crystal device which ameliorates the above disadvantage.

According to a first aspect of the present invention, there is provided a method of addressing a liquid crystal device having a first plurality of electrodes and a second plurality of electrodes defining a plurality of pixels at the intersections between at least one of the first plurality of electrodes and at least one of the second plurality of electrodes, the method comprising applying one frame of a scanning signal to one of the first plurality of electrodes, applying a data signal to at least one of the second plurality of electrodes, one frame of the scanning signal comprising n strobe portions, where n is an integer greater than 1, for co-operation with the at least one data signal to address one of the plurality of pixels, and at least one blanking portion, the number of blanking portions not exceeding (n−1).

The invention is based on the realization that the device can provide a useful number of grey levels without requiring a blanking pulse before each strobe pulse S.

According to a second aspect of the present invention, there is provided a liquid crystal device having a first plurality of electrodes and a second plurality of electrodes defining a plurality of pixels at the intersections between at least one of the first plurality of electrodes and at least one of the second plurality of electrodes, further comprising means for applying one frame of a scanning signal to one of the first plurality of electrodes, means for applying a data signal to at least one of the second plurality of electrodes, wherein one frame of the scanning signal comprises n strobe portions, where n is an integer greater than 1 , for co-operation with the at least one data signal to address one of the plurality of pixels, and at least one blanking portion, the number of blanking portions not exceeding (n−1).

According to a third aspect of the present invention, there is provided an addressing arrangement for a liquid crystal device having a first plurality of electrodes and a second plurality of electrodes defining a plurality of pixels at the intersections between at least one of the first plurality of electrodes and at least one of the second plurality of electrodes, the arrangement comprising means for applying one frame of a scanning signal to one of the first plurality of electrodes, means for applying a data signal to at least one of the second plurality of electrodes, wherein one frame of each of the scanning signal comprises n strobe portions, where n is an integer greater than 1, for cooperation with the at least one data signal to address one of the plurality of pixels, and at least one blanking portion, the number of the blanking portions not exceeding (n−1).

At least two of the strobe portions of the scanning signals may have different polarities.

Preferably, first and second scanning signals are applied to adjacent ones of the first plurality of electrodes (row electrodes). This increases the number of possible grey levels for a given number of strobe portions per frame. The scanning signals may blank their respective rows to the same state or to opposite states.

Simultaneous strobe portions of the first and second scanning signals may have opposite polarity.

Preferably, three data signal types are provided, the third providing the same response regardless of the polarity of the strobe signal with which it is applied.

Further features of the invention are set out in the accompanying dependent claims and will be apparent to the skilled person from the detailed description which follows.

BRIEF DESCRIPTION OF THE DRAWING

The present invention will now be described by way of example with reference to the accompanying figures, in which.

DESCRIPTION OF THE PREFERRED EMBODIMENTS

Figure 1:
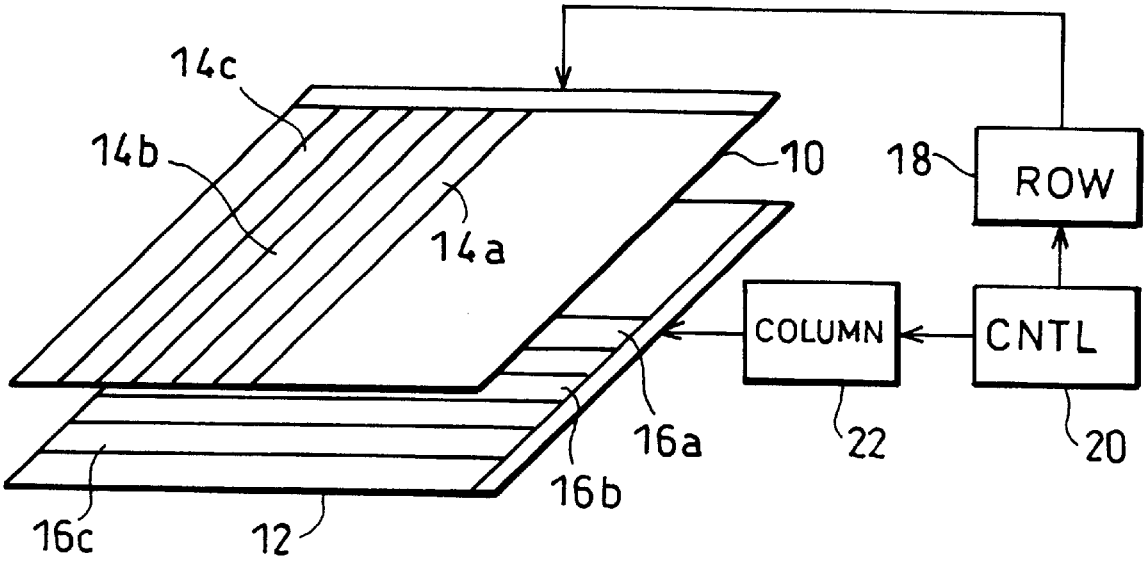
FIG. 1 shows a crossed electrode arrangement on a liquid crystal array device together with row and column drivers.

FIG. 1 shows a perspective view of a liquid crystal array device to which the addressing technique of the present invention may be applied. A first substrate 10 is arranged opposite a second substrate 12 and liquid crystal material (not shown) would be arranged between the substrates. The substrate 10 carries a plurality of electrodes 14 arranged parallel to one another. For simplicity, Figure I shows only three of these electrodes 14*a*, 14*b* and 14*c*. The substrate 12 also carries a plurality of electrodes 16 arranged parallel to one another. For clarity, only three electrodes 16*a*, 16*b* and 16*c* are shown. The electrodes 16 are arranged to lie at right angles to the electrodes 14 and the point at which one of the electrodes 14 overlaps one of the electrodes 16 defines a picture element or pixel of the array. The invention may be applied to liquid crystal devices having other arrangements of electrodes. The electrodes 14 are called the row electrodes and are driven by a controller (CNTL) 20 via a row driver (ROW) 18. The electrodes 16 are driven by the controller via a column driver (COLUMN) 22.

In order to uniquely address the pixels in an array such as shown in FIG. 1, a scanning signal is applied in turn to each of one of the row electrodes. Data signals are then applied to the other plurality of electrodes to co-operate with the scanning signals. Because the data signals are applied to all of the pixels in a particular column of the array, the relative amplitude and duration of the scanning signal and data signal must be arranged so that only the pixels in the row or rows to which the scanning signal is applied change state in accordance with the data signals.

Figure 2:
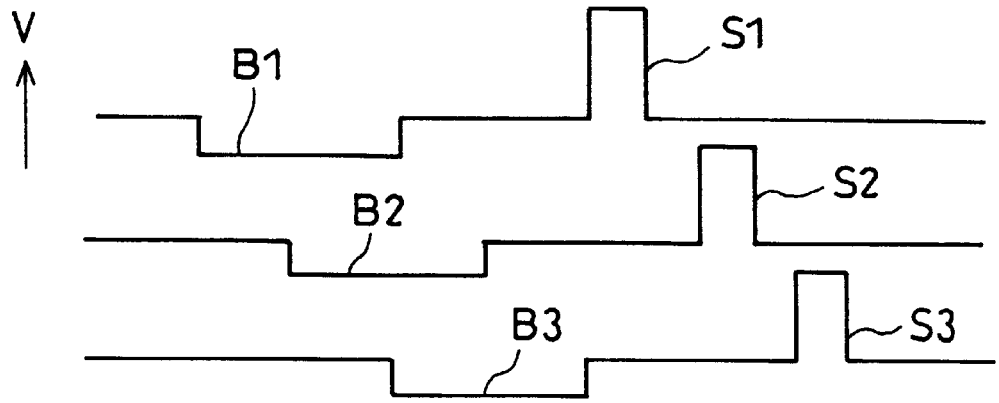
FIGS. 2(*a*) and 2(*b*) show scanning signals for addressing liquid crystal displays in accordance with the prior art.
Figure 2:
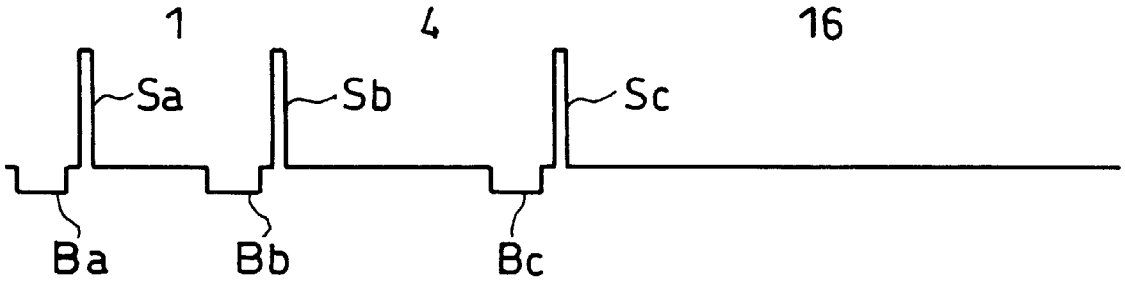

FIG. 2(*a*) shows typical prior art scanning signal waveforms for application to the row electrode. The vertical axis represents voltage V and the horizontal axis represents time t. The signals applied to three adjacent row electrodes are shown in the figure. A first scanning signal comprises a blanking portion B1 and a strobe portion S1. A second scanning signal comprises a blanking portion B2 and a strobe portion S2 while a third scanning signal comprises a blanking portion B3 and a strobe portion S3. The blanking portion of the scanning signal is arranged to place all of the pixels in the row to which it is applied into a first state (typically minimum light transmission or black). The strobe portion of the signal is then applied simultaneously with a relevant data signal applied to the other set of electrodes. By selection of the type of data signal the state of the pixel (black or white) can be selected. The second scanning signal is applied to the next row electrode and a data signal applied as appropriate. The third scanning signal is applied to the next row electrode and so on until the entire array has been addressed. Note that the application of the blanking portion occurs several rows before the strobe portion. The addressing of the entire array takes a time called a frame and the frequency with which the entire array is addressed is called the frame rate.

The scanning signal waveforms shown in FIG. 2(*a*) contain only one blanking portion and one strobe portion applied to each row electrode during a single frame. An addressing technique known as temporal dither addresses each row of the array more often than once per frame. This allows data signals to be applied to select the state of each pixel more than once during any given frame. By switching the pixel to the dark or white state more often than once per frame, the pixel will appear to the human eye as occupying a state somewhere in between white and black. This allows so-called temporal grey scale to be achieved.

FIG. 2(*b*) shows a scanning signal for providing temporal dither, the figure is clearly not to scale. The signal shown in FIG. 2(*b*) comprises three blanking portions Ba, Bb and Bc followed respectively by three strobe portions Sa, Sb and Sc. The time intervals between Sa and Sb, between Sb and Sc, and between Sc and Sa are in the ratio 1:4:16 respectively.

Thus, by applying a data signal which switches the pixel white while strobe portion Sa is applied and applying data signals which leave the pixel black in response to strobe portions Sb and Sc a relative brightness of 1 is achieved. By turning the pixel white in response to strobe portion Sb only, a relative brightness of 4 is achieved and so on. Clearly, a number of other rows are addressed in the periods between the strobe portions Sa, Sb and Sc. The number of rows addressed in these intervening periods will depend upon the number of rows in the array and will be selected to provide, as nearly as possible, the desired ratio of the inter-strobe durations. A major drawback with this prior art scanning signal is that the blanking portions Ba, Bb and Bc must be applied a finite time before the pixel is addressed using the corresponding strobe portion Sa, Sb and Sc. Since these blanking portions will typically blank the pixel to black, this results in a finite period of time during the frame in which the pixel occupies the black state. If maximum light transmission is desired (white pixel state selected using all of the strobe portions Sa, Sb and Sc) then the periods of black state caused by the blanking portions will reduce the brightness of the pixel and can also reduce contrast as discussed above. Alternatively, if the blanking portions are arranged to blank the pixel to the white state then a loss of contrast occurs. If, for example, minimum light transmission is required (black state) then there will be a finite time during the frame in which the pixel occupies the light state, thus reducing contrast.

In addition to the use of temporal dither techniques, it is common to also employ so called spatial dither. In a simple example, each pixel is divided into two parts and the two parts are addressed by separate data electrodes. This permits different parts of the pixel to occupy different states in accordance with the data signals which are applied to them. In combination with temporal dither, an increased number of grey levels can be achieved. In order to reduce redundancy, the relative sizes of the two parts of each pixel are usually of different sizes. This may be easily achieved by using two data electrodes of different widths to define the pixel.

Figure 3:
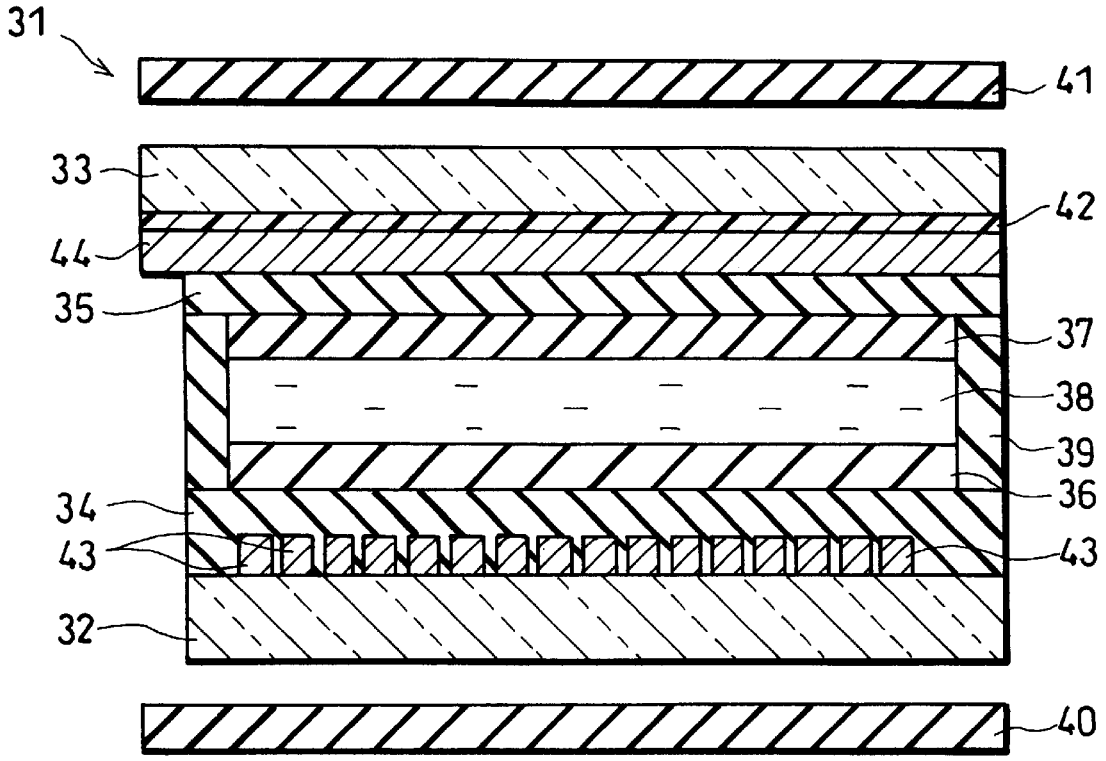
FIG. 3 shows a side elevational view of a ferroelectric liquid crystal device to which the present invention can be applied.

A ferroelectric liquid crystal display (FLCD) panel 31 to which the invention can be applied is shown diagrammatically in FIG. 3. The FLCD panel 31 comprises a layer 38 of ferroelectric smectic liquid crystal material contained between two parallel glass substrates 32 and 33 bearing first and second electrode structures on their inside surfaces, a colour filter layer 42 being interposed between the substrate 33 and the corresponding electrode structure. The first and second electrode structures comprise respectively a series of row and column electrodes 43 and 44 of, for example, indium tin oxide electrodes which cross one another to form a matrix of modulating elements (pixels) at the intersections of the electrodes 43, 44. Each of the electrode structures is coated with a transparent insulating film 34 or 35 made of silicon oxide ($SiO_2$), for example. Furthermore alignment layers 36 and 37 made of polyimide, for example, are applied on top of the insulating films 34 and 35 so that the alignment layers 36 and 37 contact opposite sides of the ferroelectric liquid crystal layer 38 which is sealed at its edges by a sealing member 39. The panel 31 is disposed between polarisers 40 and 41 having polarising axes which are substantially perpendicular to one another.

The invention is particularly applicable to a ferroelectric liquid crystal (FLC) panel, where the liquid crystal material has the following properties:

(i) a liquid crystal with a chiral smectic C phase at the operating temperature;

(ii) a material showing τ-Vmin characteristics, hence having a spontaneous polarisation less than 20 $nC/cm^2$;

(iii) an FLC material with a cone angle between 10 and 45 degrees;

(iv) an FLC material with positive dielectric biaxiality.

Figure 4:
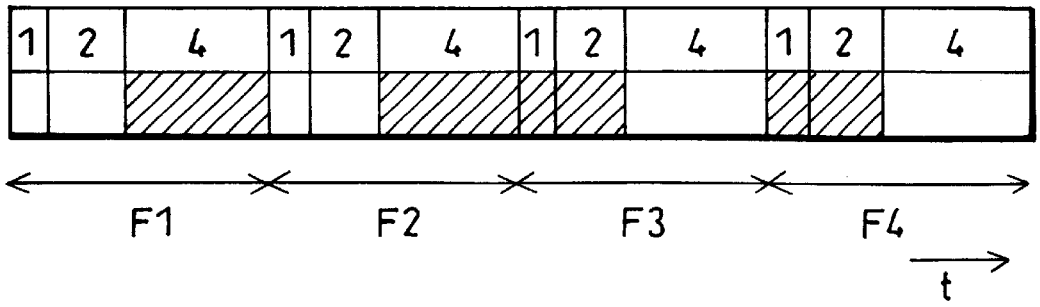
FIG. 4 illustrates a problem encountered with moving images on temporal dither displays known as dynamic false contouring (or pseudo-edge)

There is one further problem with multiplexed addressing of liquid crystal arrays to be explained. FIG. 4 shows a diagram of a straightforward binary-weighted temporal dither technique having durations between strobe portions in the ratio 1:2:4. Four frame durations F1, F2, F3 and F4 are shown and the horizontal axis is time t. In frames F1 and F2 a relative brightness level of 3 is required so that the pixel is arranged to switch to the white state in response to the strobe portions of the scanning signal which correspond to the time durations 1 and 2. The pixel is arranged to remain black in response to the strobe portion corresponding to the time duration 4. In frames F3 and F4 a relative brightness level of 4 is desired and the addressing of the pixel is reversed so as to occupy the white state during the relative duration of 4. However, at the transition between frame F2 and frame F3 there is a duration equal to an entire frame in which the pixel occupies the black state. Because the human eye is sensitive to changes in light intensity at around the frame rate this results in the pixel being perceived as black rather than the desired intermediate grey level(s). This manifests itself on a large area display as a black line appearing at the boundary between slightly different shades of grey moving across the display. The problem is described in greater detail, in the context of plasma display panels, in "Degradation of moving-image quality in PDPs: Dynamic False Contours" by Yamaguchi et al in The Journal of the SID, 4/4, 1996. Certain preferred embodiments of the present invention described hereinafter also address this problem.

Figure 5:
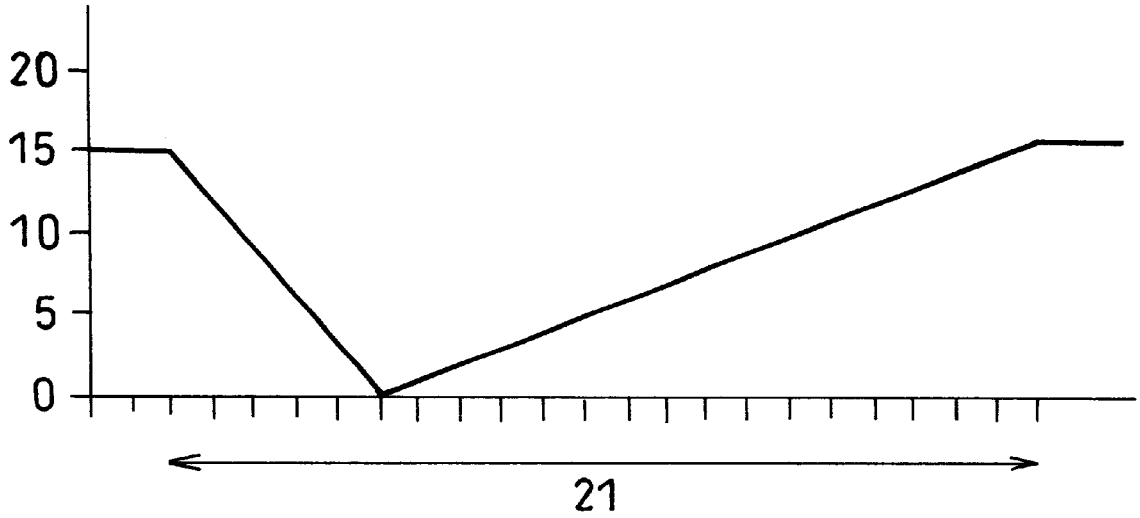
FIGS. 5(*a*) and 5(*b*) illustrate the improvement in dynamic false contouring that can be achieved by altering the relative temporal dither durations.
Figure 5:
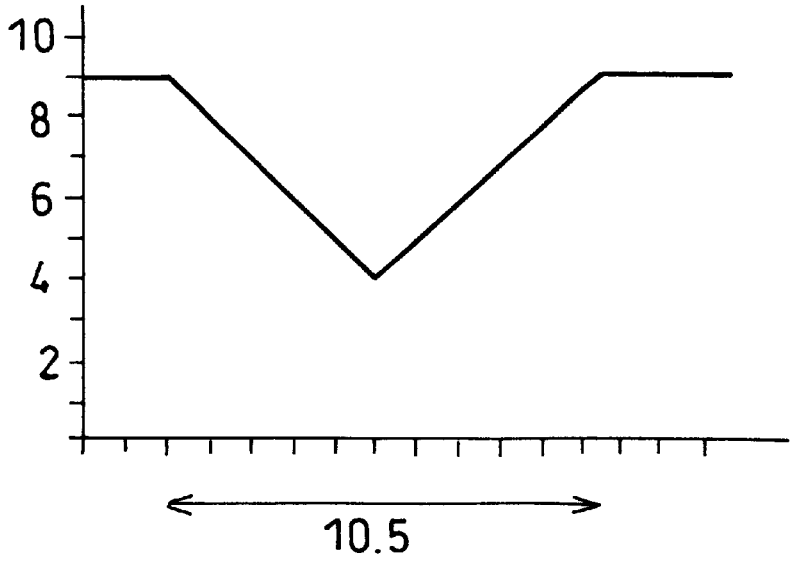

FIG. 5 illustrates the advantage of having a smaller difference in duration between the largest time duration and the next longest time duration. FIG. 5(*a*) shows the perceived transmission levels of a pixel (vertical axis) being driven by temporal dither in the ratio 1:4:16 when the transmission level changes from 15 to 16. A maximum drop in transmission level of 23.4% is observed and the pixel takes a total of 21 periods of time (horizontal axis) to attain the new transmission level.

By contrast, FIG. 5(*b*) shows the perceived transmission levels of a pixel being driven by temporal dither in the ratio 1:4:5.5 when the transmission level changes from 9 to 9.5. A maximum drop in transmission level (vertical axis) of only 15.6% is observed and the pixel attains its new transmission level in only 10.5 periods (horizontal axis).

Figure 6:
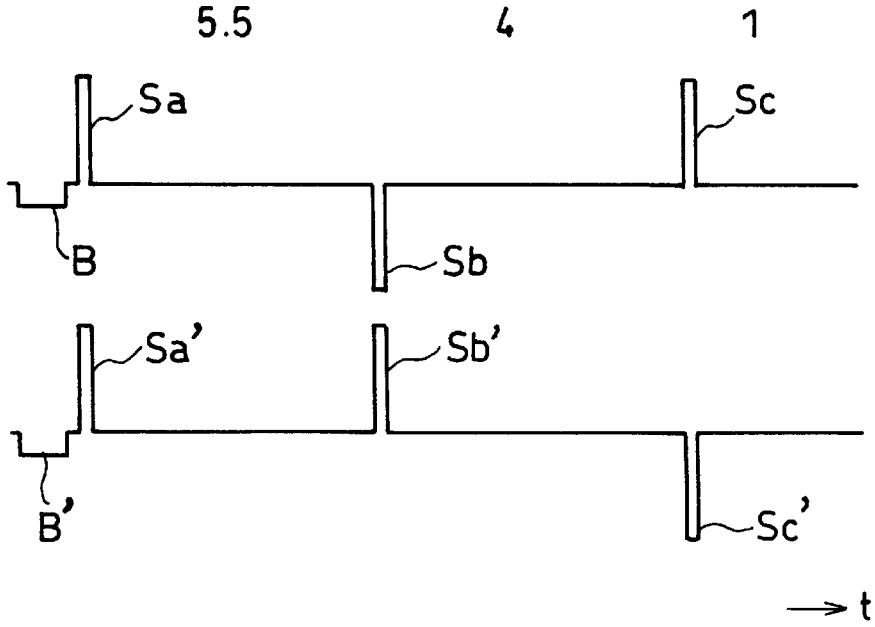
FIGS. 6(*a*) and 6(*b*) show scanning signals in accordance with the present invention.

FIG. 6 shows a schematic diagram of a pair of scanning signals in accordance with a preferred embodiment of the present invention. In this embodiment, each pixel of the array is defined by two row electrodes and at least one column electrode. In this case, the pixel is actually defined by two column (data) electrodes in order to provide spatial dither. The ratio of the widths of the column electrodes is 1:2 in order to provide spatial dither with a relative weighting of 1:2.

FIG. 6(*a*) shows a first scanning signal comprising a blanking portion B and strobe portions Sa, Sb and Sc. FIG. 6(*b*) shows a second scanning signal comprising a blanking portion B' and strobe portions Sa', Sb' and Sc'. The scanning signals shown in FIGS. 6(*a*) and 6(*b*) are applied to adjacent row electrodes which define a single pixel. It is important to note that while there are three strobe portions of each signal, there is only one blanking portion in each signal. The ratio of the inter-strobe durations is 5.5:4:1.

While the polarity of the strobe portion Sa' is the same as the polarity of the strobe portion Sa, the polarity of the remaining strobe portions of the two signals are inverted with respect to each other. In the case of the scanning signal waveform shown in FIG. 6(*a*) , the following occurs. The blanking portion of the signal B blanks the part of the pixel to which the row electrode relates to occupy the black state. A data signal applied simultaneously with the strobe portion Sa may leave the pixel in the black state or switch the pixel to the white state. Because the polarity of the strobe portion Sb is the same as the blanking signal, this strobe portion permits the pixel to be switched black. Thus, a data signal applied simultaneously with the strobe portion Sb could, if the pixel is already in the white state, be selected to switch the pixel to the black state or leave it in the white state. If the pixel is in the dark state following strobe portion Sa then strobe portion Sb cannot be used to switch it to the white state.

The final strobe portion Sc is of opposite polarity to the blanking portion B and so a data signal applied simultaneously with this strobe portion may, if the pixel is already in the black state, be selected to switch the pixel to the white state or leave the pixel in the black state.

A similar analysis can be applied to the scanning signal shown in FIG. 6(*b*). The blanking signal B' blanks the pixel to the black state and a data signal applied simultaneously with the strobe signal Sa' may be selected to switch the pixel to the white state or leave it in the black state. If the pixel is left in the black state a data signal applied simultaneously with the strobe portion Sb' may be selected to switch the pixel to the white state or leave it in the black state. The polarity of the strobe portion Sc' means that, if the pixel is already in the white state, a data signal applied simultaneously with this strobe portion may be selected to switch the pixel to the black state or leave the pixel in the white state.

Some flexibility in addressing the pixels is lost by only having one blanking portion per frame of the scanning signal. By careful selection of the relative weightings of the temporal dither (and any accompanying spatial dither) a large number of grey levels can be achieved as will be illustrated subsequently.

Figure 8:
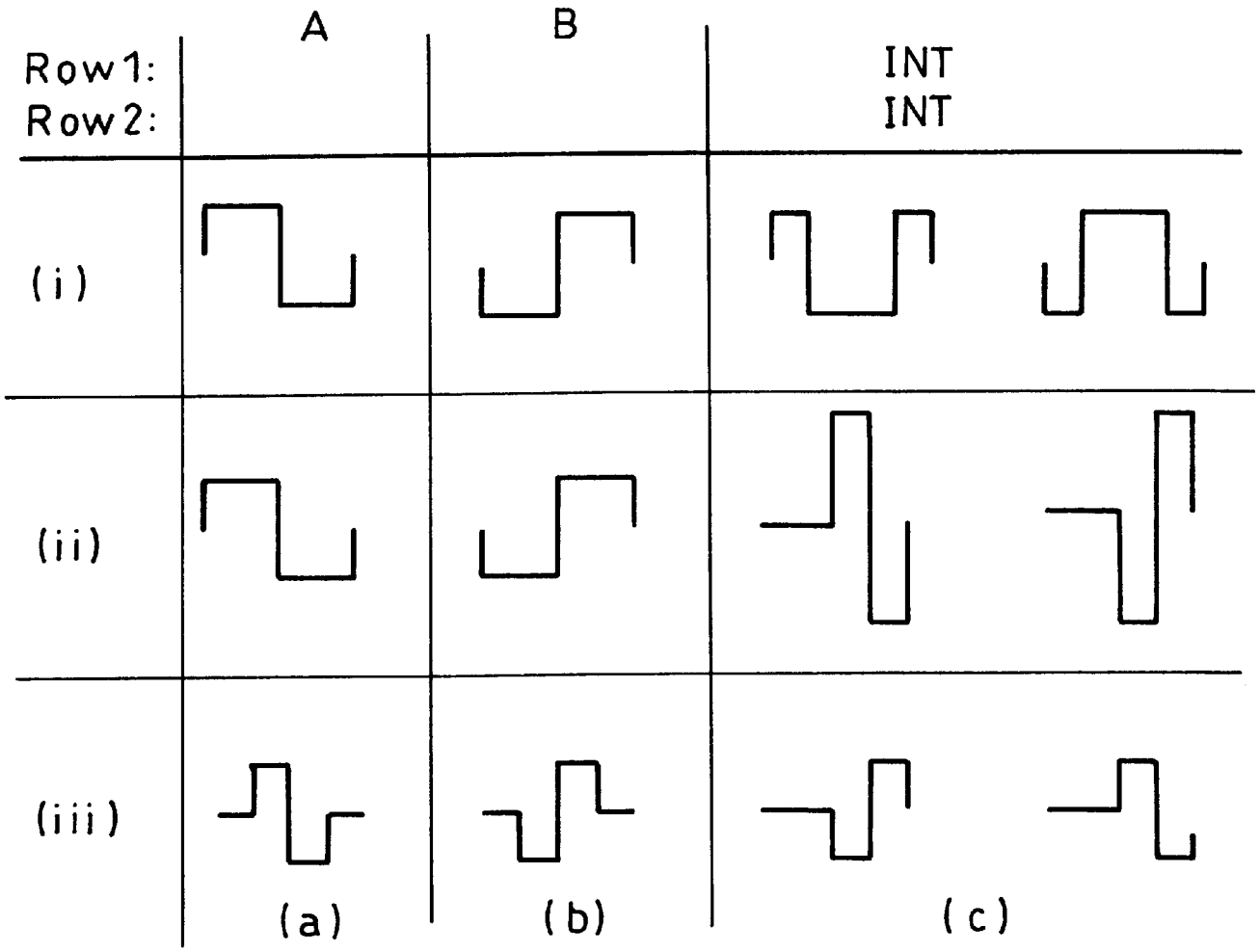
FIG. 8 gives three examples of data signals for use with the present invention.

When the two rows of the array are addressed simultaneously but with opposite polarity strobe portions each of the two digital data types will have an opposite effect on the pixels in each row. The data type which causes switching in conjunction with a positive polarity strobe portion will not cause switching in conjunction with a negative polarity strobe pulse while the data type which causes switching in conjunction with a negative polarity strobe portion will not cause switching in conjunction with the positive polarity strobe portion. It is also possible to use a third intermediate data type which has the same effect on pixels in conjunctions with both polarity strobe portions. Some examples of these three data types are shown in FIG. 8. FIG. 8 gives three examples of sets of data signals (i), (ii) and (iii). FIG. 8(i)(a) and (b) show typical data signals for switching and non-switching of a pixel respectively. Such signals are well known. FIG. 8(i) (c) however, shows two possible intermediate (INT) data signals. These data signals are for use in conjunction with strobe portions of the scanning signal only when the polarity of the strobe portions of the signals applied to two rows of the array are different. In the example shown in FIG. 6, an intermediate data signal may be used in conjunction with the strobe portions Sb, Sb' and Sc, Sc'.

Consider the strobe signal portions Sb and Sb'. If the data signal shown in FIG. 8(i)(a) is applied to an array simultaneously with these strobe portions of the scanning signal, then the pixel addressed by the scanning signal of FIG. 6(*a*) will adopt a different state from that pixel addressed by the signal in FIG. 6(*b*). The pixel addressed by the first scanning signal will not change state, while the pixel addressed by the second scanning signal will change state (assuming in both cases that the pixel already occupies a state which can be switched by that particular strobe portion). The data signal shown in FIG. 8(i) (b) will have the opposite effect from that shown in FIG. 8(i)(a) .

The purpose of the intermediate data signal is to have the same effect on the two pixels despite the fact that the scanning signal applied to them has a simultaneous strobe portion of different polarity. Two intermediate data signals are thus possible, one of which will cause switching in response to a strobe portion of either polarity or one of which will not cause switching in response to a strobe portion of either polarity. It is not possible to provide both once an operation point has been chosen, and in the following example an intermediate data signal which will not cause switching is considered.

FIG. 8(ii) and (iii) gives some further examples of possible sets of data signals. Some of these will give better driving margins than others depending on the liquid crystal device and material.

Figure 7:
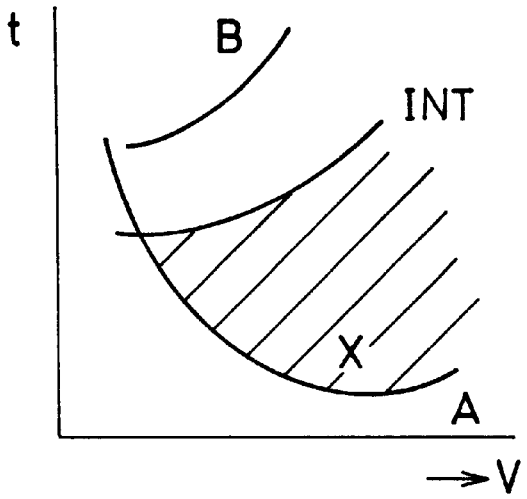
FIGS. 7(*a*) and 7(*b*) show the drive window for the first and second simultaneously addressed lines.
Figure 7:
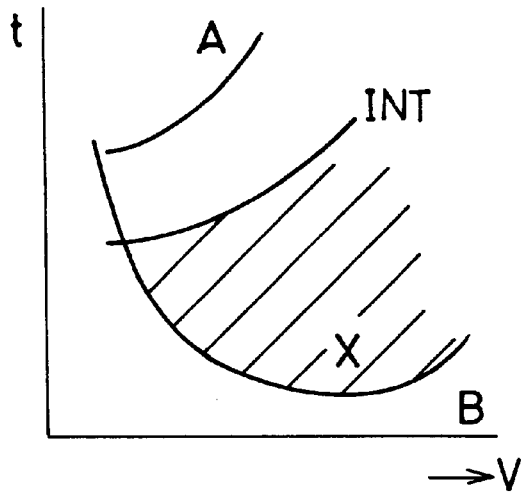

FIG. 7 shows schematic graphs of the performance of an addressing technique using three data signal types. FIG. 7(*a*) shows a graph of applied strobe voltage against time for the signals applied to the pixel. The lower curve, labelled A, illustrates the smallest voltage time product which can be applied to cause switching of the pixel state with data type A. The upper curve, labelled B, illustrates the smallest voltage time product which causes switching with data type B applied. As can be seen in FIG. 7(*b*), the positions of these two curves swap places when an opposite polarity strobe is applied. The two curves labelled INT define smallest voltage-time products which cause switching when the intermediate data signal is applied, i.e. neither polarity of strobe signal applied with this data signal will change the state of a pixel if the operating point is chosen below this curve. A DRIVE WINDOW is shown between the INT curve and the lowest data curve. A cross marks a suitable strobe voltage-time product within this drive window.

The scanning signal shown in FIG. 6 together with data signals taken, for example, from FIG. 8(i) may be used to produce 64 levels when the temporal dither arrangement is used in conjunction with two bit spatial dither. The parts of the pixel are weighted in the ratio 2:1 to provide spatial dither. The following table shows the permutations obtainable from the temporal dither arrangement in accordance with the embodiment of the invention.

| A | B | C | TOTAL | NORMALIZED TO 1 |
|---|---|---|---|---|
| 5.5 | 4 | 1 | | |
| 0 | 0 | 0 | 0 | 0 |
| 0 | 0 | 0.5 | 0.5 | 0.047619 |
| 0 | 0.5 | 0 | 2 | 0.190476 |
| 0 | 0.5 | 0.5 | 2.5 | 0.238095 |
| 1 | 0.5 | 0.5 | 8 | 0.761905 |
| 1 | 0.5 | 1 | 8.5 | 0.809524 |
| 1 | 1 | 0.5 | 10 | 0.952381 |
| 1 | 1 | 1 | 10.5 | 1 |

This can be compared with the temporal dither available using a prior art 16:4:1 binary-weighted temporal dither arrangement.

| A | B | C | TOTAL | NORMALIZED TO 1 |
|---|---|---|---|---|
| 16 | 4 | 1 | | |
| 0 | 0 | 0 | 0 | 0 |
| 0 | 0 | 1 | 1 | 0.047619 |
| 0 | 1 | 0 | 4 | 0.190476 |
| 0 | 1 | 1 | 5 | 0.238095 |
| 1 | 0 | 0 | 16 | 0.761905 |
| 1 | 0 | 1 | 17 | 0.809524 |
| 1 | 1 | 0 | 20 | 0.952381 |
| 1 | 1 | 1 | 21 | 1 |

The same range of temporal dither is available but the greater difference between the largest inter-strobe portion and the next largest inter-strobe portion mean that pseudo edge will be a problem in the prior art arrangement.

Figure 9:
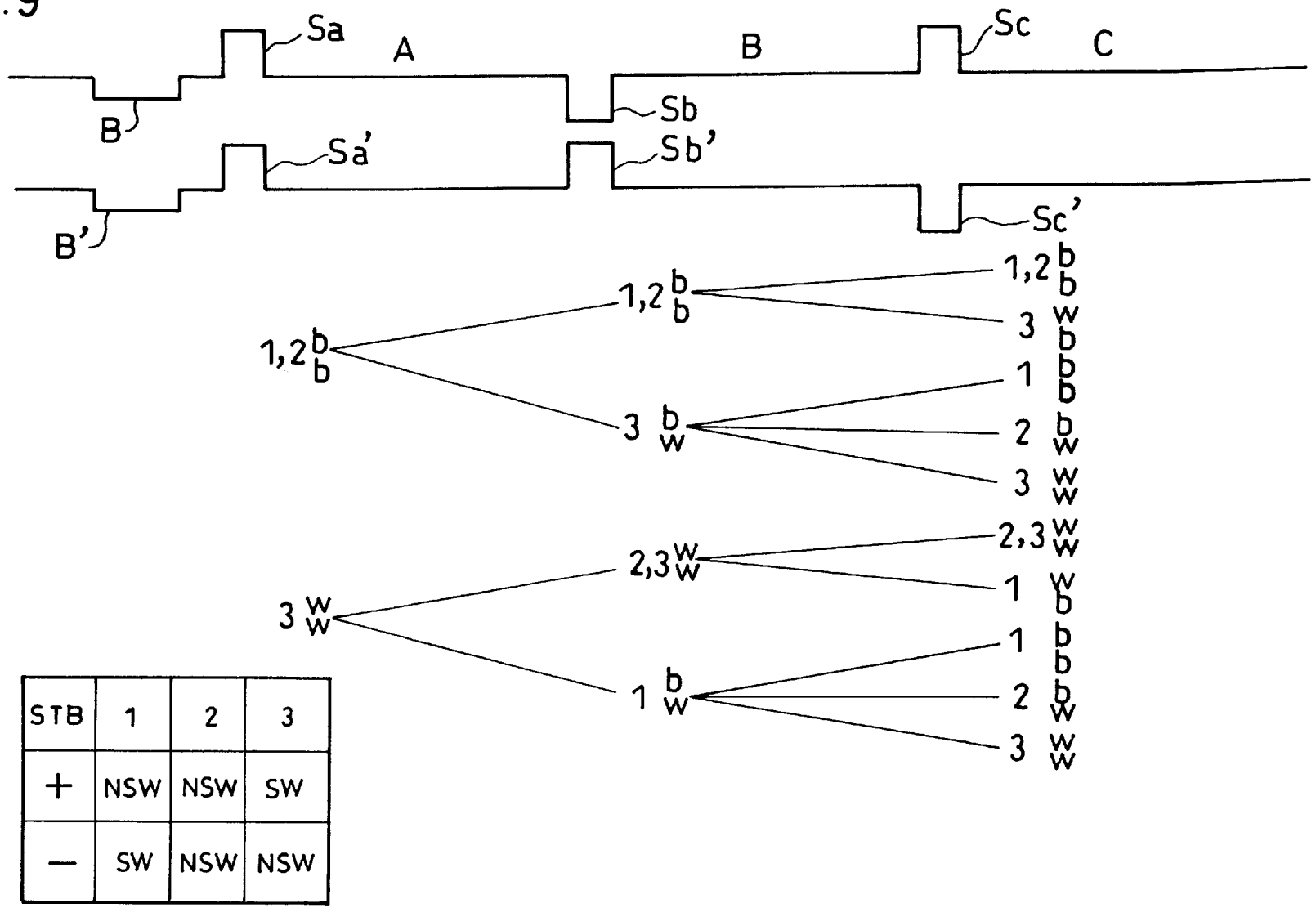
FIG. 9 shows the possible permutations of grey levels available from the scanning signals shown in FIG. 6.

Some of the permutations which might be thought to be available using the scanning signal shown in FIG. 6 are, in fact, not available because of the restrictions caused by the lack of blanking portions of the scanning signal. FIG. 9 illustrates the limitation on options using a tree diagram. The upper part of the figure shows the scanning signals already shown in FIG. 6. The lower part of the figure shows three data types which have the following effects in conjunction with positive and negative strobe portions:

1. No switching with positive strobe—switching with negative strobe;
2. (INT) No switching with either polarity of strobe;
3. Switching with positive strobe—no switching with negative strobe.

The tree diagram is used as follows:

(a) consider the previous state of the pixel in each row;

(b) note the polarity of the strobe portion (it is assumed that positive strobe portions switch white and negative strobe portions switch black);

(c) for each data signal consult the table in FIG. 9 to determine whether the combination of that polarity of strobe portion and data type results in switching (SW) or non-switching (NSW);

(d) derive the new state of pixel, previous state black positive polarity strobe non-switching=black previous state black negative polarity strobe non-switching=black previous state black positive polarity strobe switching=white previous state black negative polarity strobe switching=black previous state white positive polarity strobe non-switching=white previous state white negative polarity strobe non-switching=white previous state white positive polarity strobe switching=white previous state white negative polarity strobe switching=black We now apply the steps to the scanning waveforms shown in FIG. 9 to explain the tree diagram. Following the blanking portion B on the top row and the blanking portion B' on the bottom row, all of the pixels in both of the rows will occupy the black state. On the top row the strobe portion Sa is positive-going. From the table, we note that a positive strobe portion co-operates with data types 1 and 2 to result in non-switching (NSW) and with data type 3 to result in switching (SW). Because the previous state of the pixel was black, NSW will result in the pixel adopting a black state while SW will result in the pixel adopting a white state. Consequently, for the top row, data types 1 and 2 will result in a black state (denoted by (b) in the tree diagram) while data type 3 will result in a white state (denoted by (w) in the tree diagram).

A Since the strobe portion Sa' in the bottom row is also positive-going, the data types 1, 2 and 3 will have the same effect on pixels in the bottom row as those in the top row. Taking both these together, after the strobe portions Sa and Sa' the top and bottom row pixels will either both be black (following data type 1 or 2 ) or both be white (following data type 3).

The second strobe signal portion Sb in the top row is negative-going and so will result in a pixel switching (SW) in conjunction with data type 1 and a pixel not switching (NSW) in conjunction with data type 2 or data type 3. It is important to note that the polarity of the strobe pulse is important here. The negative-going strobe portion Sb can only switch a pixel from white to black in conjunction with data type 1. If the pixel is already in the black state then the combination of strobe portion Sb and data type 1 will not cause the pixel to switch to the white state. Therefore, if the previous state of the pixel in the top row is black then no change of state can occur in response to strobe portion Sb regardless of the data type used. If the pixel in the top row was already switched to the white state in response to strobe portion Sa (in conjunction with data type 3) then it can be switched back to the black state by strobe portion Sb in conjunction with data type 1. If the pixel in the top row is already switched to the white state in response to the strobe portion Sa then it can remain in that state if data type 2 or data type 3 are used in conjunction with strobe portion Sb.

Considering the bottom row, strobe portion Sb' is positive-going and so will cause switching in conjunction with data type 3 but no switching in conjunction with data type 1 or data type 2. Note that strobe portion Sb' can only switch from black to white. If the previous state of the pixel (following strobe pulse Sa') is white then strobe portion Sb' can have no effect on the state of the pixel regardless of the data type used.

We can now work out the states of the pixels in the top row and bottom row following the strobe portions Sb and Sb'. The top half of the tree diagram signifies that the pixel in the top row and the pixel in the bottom row both occupy the black state following strobe portions Sa and Sa'. Application of data type 1 in conjunction with strobe portions Sb and Sb' will result in switching states SW and NSW respectively. For the top row, with the negative-going strobe portion, we get switching state SW. However, the negative-going strobe portion Sb can only switch a pixel to the black state. Since the pixel in the top row is already in the black state then its state is unchanged. Application of data type 2 in conjunction with strobe portions Sb and Sb' gives switching state NSW regardless of the polarity of the strobe portion. Therefore, the two pixels will remain in the same state as previously, namely black.

Application of data type 3 in conjunction with negative-going strobe portion Sb results in switching state NSW. Therefore, the top row pixel will remain in the previous state, namely black. Application of data type 3 in conjunction with positive-going strobe portion Sb' results in switching type SW. Because the strobe portion Sb' is positive-going it can switch from black to white. Because the previous state of the bottom row pixel was black the state will change to white.

If the data type 3 was applied in conjunction with strobe portions Sa and Sa' then the previous state of both pixels before the application of strobe portions Sb and Sb' will be white. Because of the different previous states this will result in different effects of the three data types in conjunction with strobe portions Sb and Sb'. Data type 1 in conjunction with negative-going strobe portion Sb results in switching state SW. Because it is negative-going, strobe portion Sb can switch pixel state from white to black. In this case, the previous state is white and so the pixel will change state to black. Data type 1 in conjunction with positive-going strobe portion Sb' gives a switching state NSW. Consequently the bottom row pixel will not change state and will remain white.

Data type 2, in conjunction with either strobe portion Sb or Sb' results in switching state NSW. Consequently, the pixels remain in their previous state, namely white.

Data type 3, in conjunction with negative-going strobe portion Sb gives a switching type NSW. Therefore, the top row pixel will remain in its previous state, namely white. Data type 3, in conjunction with positive-going strobe portion Sb' results in switching type SW. Positive-going strobe portion Sb' can switch from black to white. Because the previous state of the pixel is white this causes no change of state. Therefore, data type 2 or data type 3 in conjunction with strobe portions Sb and Sb' results in the top row pixel and the bottom row pixel remaining white.

After the application of strobe portions Sb and Sb' there are four possibilities for the states of the top row and bottom row pixel: black/black, black/white, white/white and black/white. As before, these states need to be considered when deriving the state of the two pixels following the application of strobe portions Sc and Sc'.

Following the series of steps described above, if the previous state of both pixels is black then the application of data type 1 or data type 2 in conjunction with strobe portions Sc and Sc' will result in both pixels remaining in the black state. With the same previous states, application of data type 3 in conjunction with strobe portions Sc and Sc' will result in the pixels being in the white state and black state respectively.

Where the pixels are in the black state and white state respectively following strobe portions Sb and Sb', data type 1 results in pixel states black/black, data type 2 results in pixel states black/white and data type 3 results in pixel states white/white.

Where the previous state of the pixels is white/white following strobe portions Sb and Sb' data type 1 will result in pixel states white/black and data type 2 and data type 3 will result in pixel states white/white in conjunction with strobe portions Sc and Sc'.

Where the previous state of the pixels is black/white following strobe portions Sb and Sb' data type 1 will results in pixel states black/black, data type 2 will result in pixel states black/white and data type 3 will result in pixel states white/white in conjunction with strobe portions Sc and Sc'.

FIG. 9 illustrates all of the above switching options.

By variation in the ratio of durations of the temporal dither, further grey levels may be obtained. For example, using the ratio 7.5:4:1 the following grey levels result from the temporal dither. Used in conjunction with 1:2 spatial dither, 76 levels result.

| A | B | C | TOTAL | NORMALIZED TO 1 |
|---|---|---|---|---|
| 7.5 | 4 | 1 | | |
| 0 | 0 | 0 | 0 | 0 |
| 0 | 0 | 0.5 | 0.5 | 0.04 |
| 0 | 0.5 | 0 | 2 | 0.16 |
| 0 | 0.5 | 0.5 | 2.5 | 0.2 |
| 0 | 0.5 | 1 | 3 | 0.24 |
| 1 | 0.5 | 0 | 9.5 | 0.76 |
| 1 | 0.5 | 0.5 | 10 | 0.08 |
| 1 | 0.5 | 1 | 10.5 | 0.84 |
| 1 | 1 | 0.5 | 12 | 0.96 |
| 1 | 1 | 1 | 12.5 | 1 |

Figure 10:
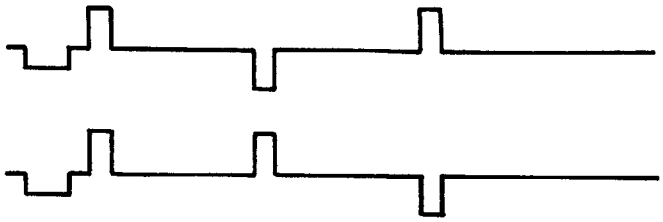
FIGS. 10(*a*) , 10(*b*), 10(*c*), 10(*d*), and 10(*e*) show some further examples of scanning signals applicable to the present invention.
Figure 10:
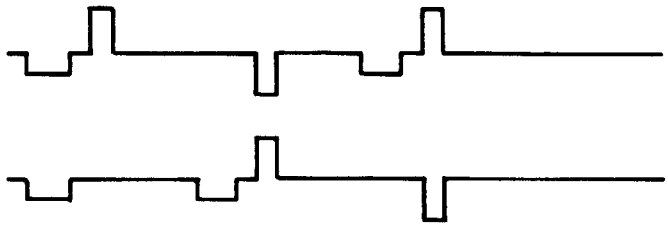
Figure 10:
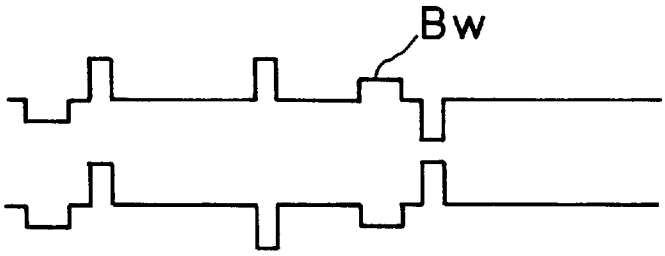
Figure 10:
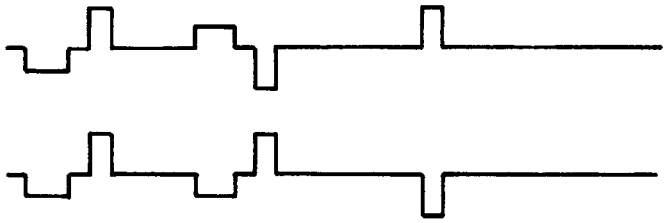
Figure 10:
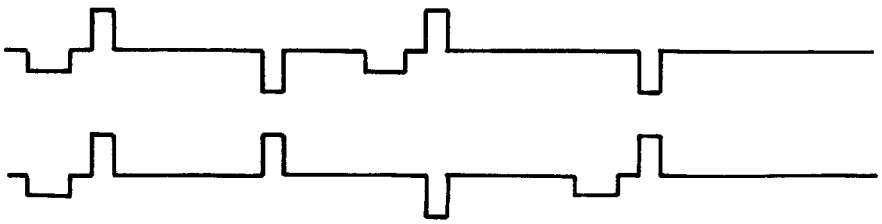

FIG. 10 gives further examples of scanning signal waveforms in accordance with the present invention. FIG. 10(*a*) shows the example already described with reference to FIG. 6 to allow comparison.

FIG. 10(*b*) shows an example for use in the temporal dither ratio 19:4:1 to result in 88 levels when used with temporal al dither in conjunction with 1:2 spatial dither. Thus we have 88 grey levels and no white blanking which give contrast benefits.

FIG. 10(*c*) shows scanning signal waveforms which result in 112 levels (with the 1:2 spatial dither) when used with temporal dither either in the ratio 13.5:1:4 or in the ratio 10.5:7:1. It should be noted that the first scanning signal in this example comprises a blanking portion Bw which blanks the pixel to white. This is a compromise to generate the larger number of levels.

FIG. 10(*d*) shows a further pair of scanning signal waveforms in accordance with an embodiment of the invention. Again, the first scanning signal comprises a portion Bw which blanks the pixel to white. This pair of scanning signals may be used to provide 124 grey levels (in conjunction with 1:2 spatial dither) when used to provide a temporal dither ratio of 15.5:1:4. The order in which the portions in the ratios 1 and 4 are provided may be reversed. This gives similar contrast to the waveforms shown in FIG. 10(*c*).

It is desirable to keep the ratio of the longest duration in the temporal dither with respect to the next longest duration quite low in order to reduce the pseudo-edge effect described with reference to FIG. 4.

FIG. 10(*e*) gives a further example of a pair of scanning signals in accordance with an embodiment of the invention, which signals comprise four strobe portions. There is no white blanking applied by these signals. In conjunction with 1:2 spatial dither, this pair of waveforms may be used to provide 351 levels using temporal dither ratios of 34.5:19:4:1. This also substantially avoids pseudo edge problems compared with conventional 4 bit temporal dither (1:4:16:64).

In the previous examples there are at most 3 levels obtainable within any one subframe (0%, 50%, and 100% transmission levels). In order to increase the number of grey levels within a subframe further intermediate analogue transmission levels can be used. However these transmission levels are difficult to achieve without significant error due to switch history, temperature variations, cell gap variations, etc. In addition, when these error-producing analogue levels are combined with digital dither techniques the error on each analogue level is multiplied by the size of the digital period in which it is used. United Kingdom Patent Application No. 9710402.0 describes a technique to combine analogue levels with digital levels such that the error producing analogue levels are only used in the least or lesser significant digital bits. United Kingdom Patent Application No. 9710403.8 describes an interlacing technique which can reduce the error due to temperature variations and/or cell gap variations. Two rows are addressed simultaneously with opposite polarity blanking and strobe pulses. As the data has the opposite effect on opposite polarity strobes any shift in temperature or cell gap will cause the transmission levels to move in opposite directions keeping the average between the two constant. The operating point is chosen such that a 50% transmission level is truly a 50% analogue level in both the top and bottom pixel. As the grey level moves up in one pixel due to error the grey level will move down in the other pixel. Total failure of the analogue switching therefore results in one pixel being black and one pixel being white. This still results in an overall transmission of 50% and is the operating condition for the intermediate level in previous examples. A disadvantage of this technique is the requirement for white blanking which reduces contrast.

Figure 11:
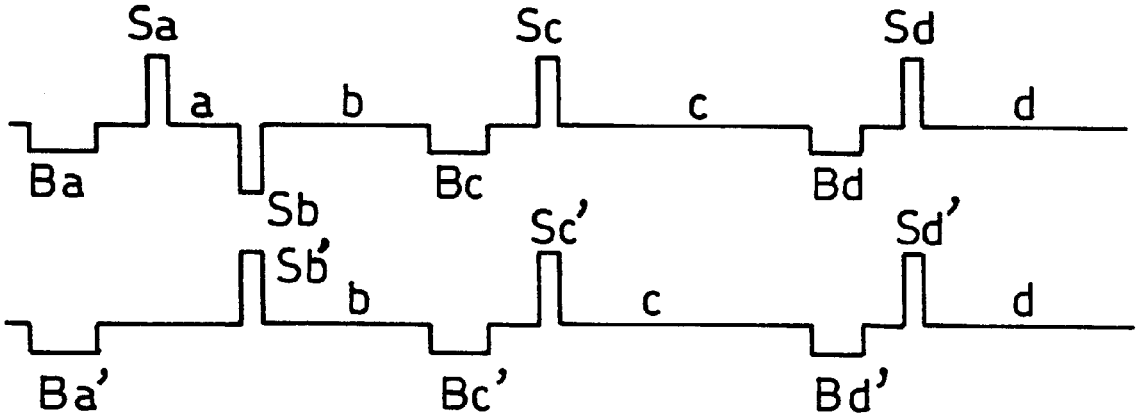
FIG. 11 shows another example of scanning signal applicable to the present invention.

In order to have the benefit of switching to analogue levels from the white and black state on alternate lines without blanking white, a white select period can be incorporated (Sa in FIG. 11). The ratio of the duration of period 'a' is made equal to the ratio of 1/(NG−1) where NG is the total number of grey levels. Subsequent grey levels can then be addressed in period 'b' where the top line switches towards black from the selected white state in period 'a' and the bottom line switches towards white from the blanked black state from B'. Therefore when a true black state (grey level 0) is required strobe Sa is applied together with a non-switch data signal and kept in the black state and the contrast is not reduced. Grey level 1 is achieved by using a switch data during strobe Sa to switch period 'a' white. Grey level 2 is achieved by switching period 'a' white and switching period 'b'. to a transmission level such that the total transmission duration period 'a' and 2 times 'b'. is equal to grey level 2.

The relative durations of the periods can be calculated from $$\frac{a}{a+2b+2c+2d} = \frac{1}{NG-1}$$

$$\frac{a+2b}{2+2b+2c+2d} = \text{analog grey scale } (AGS) \text{ ratio}$$

The AGS ratio is the period over which AGS can be applied divided by the frame time. Duration of period 'a' corresponds to one grey level. Analogue grey levels are only applied in period 'b' in this example.

Figure 12:
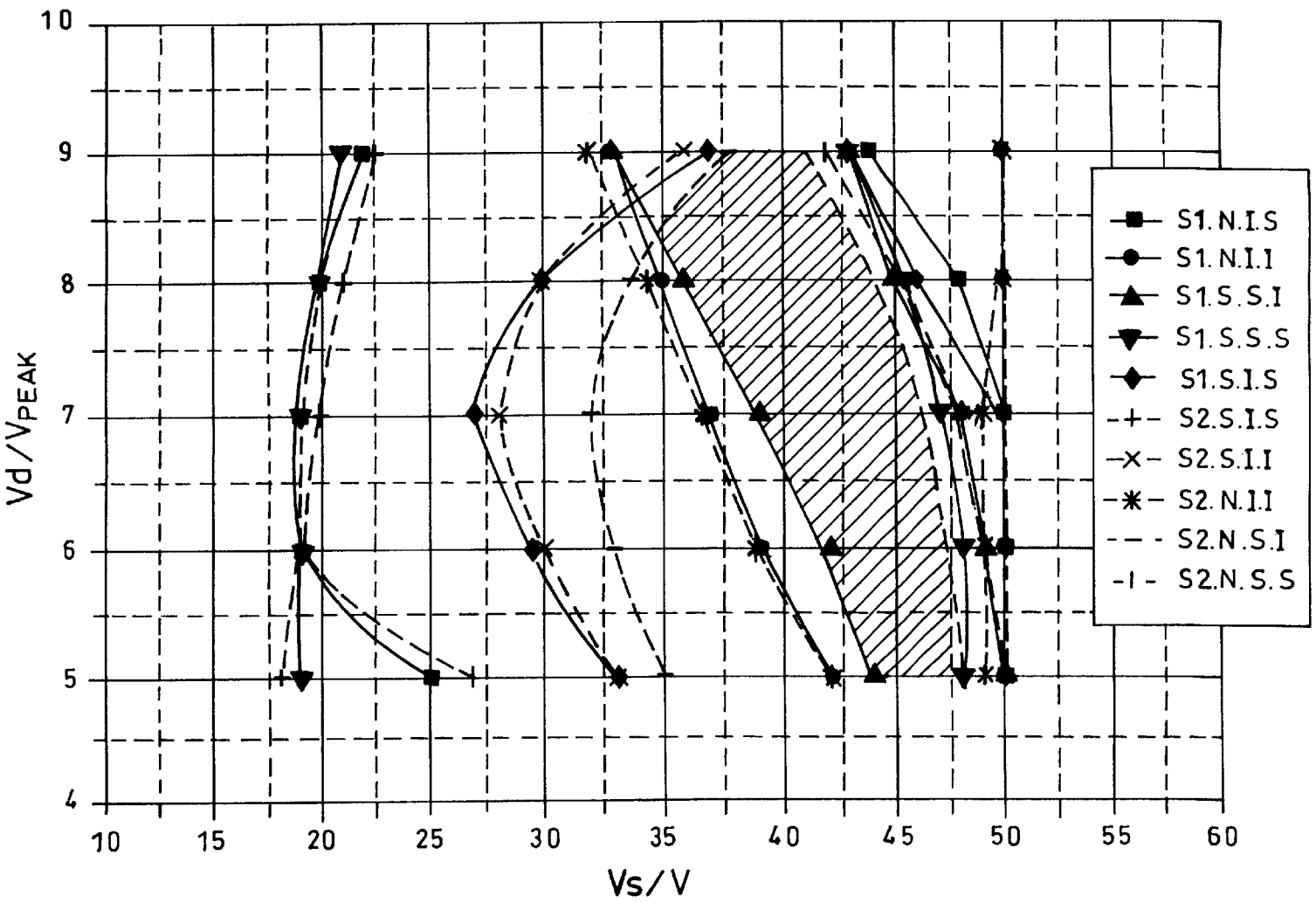
FIG. 12 shows a driving window assessment for the scanning signals applicable to the present invention.

FIG. 12 shows an example of the drive window obtained when using the strobe waveform of FIG. 6 with the data signal shown in FIG. 8 type (iii). The material used was a typical FLC material such as that described previously, for example SCE8 available from Hoescht, which shows the properties described with reference to FIG. 3. The drive window is shown in terms of the data and strobe voltages for a fixed duration of the strobe portion of the scanning signal.

The graph illustrates ten combinations of drive signals applied to the liquid crystal cell. The top row scanning signal (shown in FIG. 6(*a*)) is denoted S1. The bottom row scanning signal (shown in FIG. 6(*b*)) is denoted by S2. Five combinations of data signals are applied in conjunction with the top row scanning signal as follows:

1) A non-switching data signal (N) in conjunction with strobe portion Sa followed by an intermediate data signal (I) in conjunction with strobe portion Sb and a switching (S) data signal in conjunction with strobe portion Sc. This is shown by a solid line interrupted by filled squares;
2) A non-switching data signal (N) applied in conjunction with strobe portion Sa followed by intermediate data signals applied in conjunction with each of strobe portions Sb and Sc. This is shown by a solid line interrupted with filled circles;
3) A switching data signal (S) applied in conjunction with strobe portion Sa and strobe portion Sb followed by an intermediate data type (I) applied in conjunction with strobe portion Sc. This is denoted by a solid line interrupted by upwardly-directed filled triangles;
4) A switching data signal (S) applied in conjunction with strobe portion Sa, strobe portion Sb and strobe portion Sc. The curve is shown as a solid line with a downwardly-pointing filled triangle;
5) A switching data signal (S) applied in conjunction with strobe portion Sa, an intermediate data signal (I) applied in conjunction with strobe portion Sb and a switching data signal (S) applied in conjunction with strobe portion Sc. This is denoted by a solid line interrupted with filled diamond shapes.

The following five combinations of data signals are applied in conjunction with the bottom row scanning signal shown in FIG. 6(*b*):

1) A switching data signal (S) applied in conjunction with strobe portion Sa', an intermediate data signal (I) applied in conjunction with strobe portion Sb' followed by a switching data signal (S) applied in conjunction with strobe portion Sc'. This is denoted by a broken line interrupted by addition signs ("+");
2) A switching data signal (S) applied in conjunction with strobe portion Sa' followed by intermediate data signal (I) applied in conjunction with strobe portions Sb' and Sc'. This is denoted by a broken line interrupted by multiply signs ("×");
3) A non-switching data signal (N) applied in conjunction with strobe portion Sa' followed by intermediate data signals (I) applied in conjunction with the strobe portion Sb' and strobe portion Sc'. This is denoted on the graph by a broken line interrupted by asterisks ("*");
4) A non-switching data signal (N) applied in conjunction with strobe portion Sa' followed by a switching data signal (S) applied in conjunction with strobe portion Sb' followed by an intermediate data signal (I) applied in conjunction with strobe portion Sc'. This is denoted on the graph by a broken line;
5) A non-switching data signal (N) applied in conjunction with strobe portion Sa' followed by switching data signal (S) in conjunction with strobe portion Sb' and strobe portion Sc'. This is denoted on the graph by a broken line interrupted by short vertical lines.

The data from which the graph was compiled was derived by varying the combination of data voltage (Vd) and strobe portion voltage (Vs). Should the combination of data voltage and strobe voltage be insufficient to switch the state of the liquid crystal cell when required, then the addressing scheme will be deemed to have failed. The points on the graph (combinations of strobe and data voltage) at which such failures occur result in the ten curves on the left-hand side of the graph. Some of the required switching combinations can be achieved at comparatively low strobe and data voltages. Consider, for example, the first combination (1) of data types applied in conjunction with the top row scanning signal and denoted by solid lines interrupted by filled squares. This curve can be seen at the left-hand side of the graph shown in FIG. 12, passing approximately through the points: Vd=9, Vs=22; Vd=8, Vs=20; Vd=7, Vs=19; Vd=6, Vs=19 and Vd=5, Vs=25.

However, in practice, somewhat higher combinations of strobe and data voltage are required. In order to ensure that the correct switching occurs in response to all permutations of data signal applied, the combination of data voltage and strobe voltage must be selected to comply with the worst-case combination. In the present case, this is defined by the combination of data type (3) having switching (S), switching (S) and intermediate (I) data signals applied in conjunction with the top row scanning signal, and data type (4) having non-switching (N), switching (S) and intermediate (I) signals applied in conjunction with the bottom row scanning signal.

At the top of the graph this latter combination of data and strobe signals can be seen to fail along a dotted line between the approximate points Vd=9, Vs=38 and Vd=8.3, Vs=35. At this point it crosses the former curve (denoted by upwardly-directed filled triangles) which then extends to the approximate point Vd=5, Vs32 44. The operating range, or drive window is thus delimited on the lower side by this pair of intersecting curves.

There are a further ten curves on the right-hand side of the graph and these impose an upper limit on the combination of Vd and Vs. The curves again relate to combinations of Vd and Vs which fail, typically because the intermediate data signal has caused switching (when, of course, it should not) in conjunction with a strobe portion of the scanning signal. Note that an upper limit of 50 V was placed on the strobe portions in order to avoid damaging the device. Hence the coincidence of a number of the curves along the line Vs=50. In this case, the lowest combination of data and strobe voltage must be observed to ensure correct operation for all of the combinations of data signal and strobe signal. The limit is placed by the performance of data type (4) comprising a non-switching signal (N) followed by a switching signal (S) followed by an intermediate signal (I) applied in conjunction with the bottom row scanning signal. This is denoted on the graph by a broken line which curves from approximate point Vd=9 to Vs=41 and approximate point Vd=5, Vs=48.

In the region bounded by the two lower-voltage switching failure curves and the single higher-voltage failure curve, all of the required switching combinations behaved correctly. This area is shaded on the graph and is usually referred to as the drive window.

It is possible that the drive window shown could be improved with a different choice of data types, or by modifying the strobe waveforms (i.e. in the current example all strobes were the same voltage and duration, but they need not be).

The liquid crystal array which is addressed by applying scanning signals to two of the row electrodes simultaneously may be interlaced by applying the first and second scanning signals to different pairs of electrodes in subsequent frames. Preferably, the two adjacent electrodes to which scanning signals are provided alter by one row and then return to the original row.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of addressing a liquid crystal device having a first plurality of electrodes and a second plurality of electrodes defining a plurality of pixels at the intersections between at least one of the first plurality of electrodes and at least one of the second plurality of electrodes, the method comprising applying one frame of a scanning signal to one of the first plurality of electrodes, applying a data signal to at least one of the second plurality of electrodes, one frame of the scanning signal comprising n strobe portions, where n is an integer greater than 1, for co-operation with the at least one data signal to address one of the plurality of pixels, and at least one blanking portion, the number of blanking portions not exceeding (n−1).

2. A method of addressing a liquid crystal device as claimed in claim 1, wherein at least two of the n strobe portions of the scanning signal have opposite polarities.

3. A method as claimed in claim 1, wherein the plurality of pixels of the liquid crystal device are defined at the intersection between at least two of the first plurality of electrodes and at least one of the second plurality of electrodes, and wherein the method comprises applying one frame of a first scanning signal to a first one of the first plurality of electrodes and simultaneously applying one frame of a second scanning signal to a second one of the first plurality of electrodes.

4. A method as claimed in claim 3, wherein the at least one blanking portion of the first and second scanning signals blank the liquid crystal device to the same state.

5. A method as claimed in claim 3, wherein the at least one blanking portion of the first and second scanning signals blank the liquid crystal device to opposite states.

6. A method of addressing as claimed in claim 3, wherein at least one of the strobe portions of the first scanning signal has a different polarity from a corresponding strobe portion of the second scanning signal.

7. A method as claimed in claim 6 wherein the strobe portions which have the opposite polarities are the strobe portions except for the first strobe portions.

8. A method as claimed in claim 3, wherein at least one blanking portion of the first scanning signal differs in polarity from a blanking portion of the second scanning signal.

9. A method as claimed in claim 3, wherein the strobe portions of the first and second scanning signals are spaced from each other in time by different durations which durations are not related by a power of 2.

10. A method as claimed in claim 1, wherein the data signal comprises one of three data signal types.

11. A method as claimed in claim 10, wherein at least one of the data signal types has the same effect on a pixel regardless of the polarity of the simultaneously-applied strobe portion of the scanning signal.

12. A method as claimed in claim 3, wherein at least two of the first plurality of electrodes defining the plurality of pixels are selected differently in a first frame and a subsequent frame.

13. A liquid crystal device having a first plurality of electrodes and a second plurality of electrodes defining a plurality of pixels at the intersections between at least one of the first plurality of electrodes and at least one of the second plurality of electrodes, further comprising means for applying one frame of a scanning signal to one of the first plurality of electrodes, means for applying a data signal to at least one of the second plurality of electrodes, wherein one frame of the scanning signal comprises n strobe portions, where n is an integer greater than 1, for co-operation with the at least one data signal to address one of the plurality of pixels, and at least one blanking portion, the number of blanking portions not exceeding (n−1).

14. A liquid crystal device as claimed in claim 13, wherein at least two of the n strobe portions of the scanning signal have opposite polarities.

15. A liquid crystal device as claimed in claim 13, wherein the plurality of pixels of the liquid crystal device are defined at the intersection between at least two of the first plurality of electrodes and at least one of the second plurality of electrodes, and wherein the means for applying one frame of a first scanning signal to a first one of the first plurality of electrodes is further arranged to simultaneously apply one frame of a second scanning signal to a second one of the first plurality of electrodes.

16. A liquid crystal device as claimed in claim 15, wherein the means for applying scanning signals is arranged to provide the at least one blanking portion of the first and second scanning signals to blank the liquid crystal device to the same state.

17. A liquid crystal device as claimed in claim 15, wherein the means for applying scanning signals is arranged to provide the at least one blanking portion of the first and second scanning signals to blank the liquid crystal device to opposite states.

18. A liquid crystal device as claimed in claim 15, wherein the means for applying scanning signals is arranged to provide at least one of the strobe portions of the first scanning signal having a different polarity from a corresponding strobe portion of the second scanning signal.

19. A liquid crystal device as claimed in claim 18, wherein the means for applying scanning signals is arranged such that the strobe portions which have the opposite polarities are the strobe portions except for the first strobe portions.

20. A liquid crystal device as claimed in claim 15, wherein the means for applying scanning signals is arranged to provide at least one blanking portion of the first scanning signal which differs in polarity from a blanking portion of the second scanning signal.

21. A liquid crystal device as claimed in claim 15, wherein the means for applying scanning signals is arranged to provide strobe portions of the first and second scanning signals which are spaced from each other in time by different durations, which durations are not related by a power of 2.

22. A liquid crystal device as claimed in claim 13, wherein the means for applying a data signal is arranged to provide a data signal comprising one of three data signal types.

23. A liquid crystal device as claimed in claim 22, wherein the means for applying a data signal is arranged to provide a data signal having the same effect on a pixel regardless of the polarity of the simultaneously-applied strobe portion of the scanning signal.

24. A liquid crystal device as claimed in claim 13, wherein the means for applying a scanning signal is arranged to provide signals to at least two of the first plurality of electrodes defining the plurality of pixels which are selected differently in a first frame and a subsequent frame.

25. An addressing arrangement for a liquid crystal device having a first plurality of electrodes and a second plurality of electrodes defining a plurality of pixels at the intersections between at least one of the first plurality of electrodes and at least one of the second plurality of electrodes, the arrangement comprising means for applying one frame of a scanning signal to one of the first plurality of electrodes, means for applying a data signal to at least one of the second plurality of electrodes, wherein one frame of each of the scanning signal comprises n strobe portions, where n is an integer greater than 1, for co-operation with the at least one data signal to address one of the plurality of pixels, and at least one blanking portion, the number of the blanking portions not exceeding (n−1).

26. An addressing arrangement for a liquid crystal device as claimed in claim 25, wherein at least two of the n strobe portions of the scanning signal have opposite polarities.

27. An addressing arrangement as claimed in claim 25, wherein the plurality of pixels of the liquid crystal device are defined at the intersection between at least two of the first plurality of electrodes and at least one of the second plurality of electrodes, and wherein the means for applying one frame of a first scanning signal to a first one of the first plurality of electrodes is further arranged to simultaneously apply one frame of a second scanning signal to a second one of the first plurality of electrodes.

28. An addressing arrangement as claimed in claim 27, wherein the means for applying scanning signals is arranged to provide the at least one blanking portion of the first and second scanning signals to blank the liquid crystal device to the same state.

29. An addressing arrangement as claimed in claim 27, wherein the means for applying scanning signals is arranged to provide the at least one blanking portion of the first and second scanning signals to blank the liquid crystal device to opposite states.

30. An addressing arrangement as claimed in claim 27, wherein the means for applying scanning signals is arranged to provide at least one of the strobe portions of the first scanning signal having a different polarity from a corresponding strobe portion of the second scanning signal.

31. An addressing arrangement as claimed in claim 30 wherein the means for applying scanning signals is arranged such that the strobe portions which have the opposite polarities are the strobe portions except for the first strobe portions.

32. An addressing arrangement as claimed in claim 27, wherein the means for applying scanning signals is arranged to provide at least one blanking portion of the first scanning signal which differs in polarity from a blanking portion of the second scanning signal.

33. An addressing arrangement as claimed in claim 27, wherein the means for applying a scanning signal is arranged to provide strobe portions of the first and second scanning signals which are spaced from each other in time by different durations which durations are not related by a power of 2.

34. An addressing arrangement as claimed in claim 25, wherein the means for applying a data signal is arranged to provide a data signal comprising one of three data signal types.

35. An addressing arrangement as claimed in claim 34, wherein the means for applying a data signal is arranged to provide signals having the same effect on a pixel regardless of the polarity of the simultaneously-applied strobe portion of the scanning signal.

36. An addressing arrangement as claimed in claim 27, wherein the means for applying a scanning signal is arranged to provide signals to at least two of the first plurality of electrodes defining the plurality of pixels which are selected differently in a first frame and a subsequent frame.

* * * * *